US005127387A

United States Patent [19]

Matsuo

[11] Patent Number: 5,127,387

[45] Date of Patent: Jul. 7, 1992

[54] DISTRIBUTOR FOR AN INTERNAL COMBUSTION ENGINE

[75] Inventor: Haruyuki Matsuo, Himeji, Japan

[73] Assignee: Mitsubishi Denki Kabushiki Kaisha, Tokyo, Japan

[21] Appl. No.: 714,522

[22] Filed: Jun. 13, 1991

[30] Foreign Application Priority Data

Jun. 15, 1990 [JP] Japan ..... 2-155368

[51] Int. Cl.[5] ..... F02P 9/00

[52] U.S. Cl. ..... 123/617; 123/146.5 R

[58] Field of Search ..... 123/146.5 A, 146.5 R, 123/612, 617

[56] References Cited

U.S. PATENT DOCUMENTS

| | | | |
|---|---|---|---|
| 4,109,630 | 8/1978 | Richeson, Jr. et al. | 123/617 |
| 4,235,213 | 11/1980 | Jellissen | 123/146.5 A |
| 4,275,703 | 6/1981 | Bodig et al. | 123/617 |
| 4,359,978 | 11/1982 | Brammar et al. | 123/617 |
| 4,373,486 | 2/1983 | Nichols et al. | 123/617 |
| 4,406,272 | 9/1983 | Kiess et al. | 123/617 |
| 4,852,541 | 8/1989 | Kodama et al. | 123/617 |
| 4,887,572 | 12/1989 | Kodama et al. | 123/617 |
| 4,987,879 | 1/1991 | Chi et al. | 123/617 |

FOREIGN PATENT DOCUMENTS

| | | |
|---|---|---|
| 172512 | of 1983 | Japan . |
| 18817 | of 1986 | Japan . |

*Primary Examiner*—Raymond A. Nelli

*Attorney, Agent, or Firm*—Sughrue, Mion, Zinn, Macpeak and Seas

[57] ABSTRACT

A distributor for an internal combustion engine comprising a rotational signal generator (4) which includes a rotary magnetic shield (30) for generating an electrical signal indicative of the shaft rotational speed. The rotary magnetic shield (30) comprises a rotor plate (31) attached at the center thereof to the rotary shaft and a plurality of shield tabs (37) disposed around the plate and extending perpendicularly thereto. The rotor plate (31) and each shield tab (37) are integrally connected by a transition portion (33) including a round bend (36) for moderating stress concentration. The transition portion (33) also has integral fillets (35) defining a peripheral edge smoothly connecting the edge of the main plate (31) and side edges of the shield tabs (37) for moderating concentration of stress at edges of the transition portions (33). The fillets (35) of two adjacent transition portions (33) may define a continuously curved edge in a plane of the main plate (31).

3 Claims, 3 Drawing Sheets

DISTRIBUTOR FOR AN INTERNAL COMBUSTION ENGINE

BACKGROUND OF THE INVENTION

This invention relates to a distributor for an internal combustion engine and, more particularly, to a rotary magnetic shield vane for use in generating a rotation electrical signal in a distributor for an internal combustion engine.

FIGS. 4 and 5 illustrate one example of a conventional distributor for use in an internal combustion engine, in which reference numeral 1 designates housing, 2 designates a cap for covering an open end of the housing 1, and 3 designates a rotary shaft rotatably supported by the housing 1 and connected to an engine crank shaft (not shown) or synchronous rotation therewith.

Reference numeral 4 designates an electric signal generator mounted within the housing 1 and comprising a Hall-effect sensor unit in which a Hall-effect IC magnetic field sensor and a magnet are secured in the housing 1 by a thermo-setting plastic material with a gap 8 provided therebetween. 5 designates a a rotary magnetic shield or a vane made of a magnetic material and attached to the rotary shaft 3 through a blank 6 and a screw 7 for rotation therewith. As best seen in FIGS. 6 and 7, the rotary magnetic shield 3 is a generally disc-shaped member having our bent shield tabs 5*a* on a peripheral edge of a disc 5*d* at equal intervals. The shield tabs 5*a* of the rotary magnetic shield 5 are arranged to pass through the gap 8 formed between the field sensor and the magnet of the electrical signal generator 4 as the rotary magnetic shield is rotated by the rotary shaft 3.

Reference numeral 9 designates a distributor rotor mounted on the rotary shaft 3 for rotation therewith and having an electrode 11 in electrical contact with a center electrode 10 disposed on the cap 2. 12 designates peripheral electrodes disposed around the rotor 9 in correspondence with ignition plugs (not shown) in each engine cylinder (not shown) for receiving distributed secondary voltages from the rotor electrode 11 to generate ignition sparks on the spark plugs.

In the conventional internal combustion engine distributor of the above arrangement, as the rotary magnetic shield 5 mounted to the rotary shaft 3 is rotated by the rotation of the engine crank shaft the tabs 5*a* of the rotary magnetic shield 5 pass through the magnetic gap 8 in the signal generator 4, and the magnetic flux flowing through the gap 8 from the magnet to the Hall-effect IC sensor is interrupted. This change of magnetic flux in the gap 8 is detected by the Hall-effect IC sensor and an electrical signal indicative of the rotation of the rotary shaft 3 is generated. This signal is supplied to an ignition timing control unit (not shown) where it is used to control the ignition timing of the respective spark plugs in the engine cylinders.

In the conventional rotary magnetic shield 5, the magnetic shield tabs 5*a* are bent at substantially right angles relative to disc-shaped main body 5*d* at a small radius of curvature as illustrated by a sharp corners 5*c* in FIG. 7. Also, the sides of the shield tabs 5*a* and the periphery of the disc 5*d* define substantially right-angle corners 5*b* of a very small radius of curvature. Therefore, during the operation of the internal combustion engine, since the shield vanes or tabs 5*a* are subjected to engine vibration and centrifugal forces due to a high speed rotation, cracks may generate at the sharp corners 5*c* and edge corners 5*b*.

SUMMARY OF THE INVENTION

Accordingly, an object of the present invention is to provide a distributor for an internal combustion engine free from the above-discussed problems.

Another object of the present invention is to provide a distributor for an internal combustion engine having a more durable rotary magnetic shield disc.

A further object of the present invention is to provide a distributor for an internal combustion engine in which the rotary magnetic shield disc is strong with respect to external forces.

With the above objects in view, the distributor for an internal combustion engine of the present invention comprises a rotational signal generator generating an electrical signal indicative of rotational speed of the rotary shaft. The rotary magnetic shield comprises a disc-shaped main plate attached at the center thereof to the rotary shaft for rotation therewith and a plurality of shield tabs disposed at periphery of the main plate and extending substantially perpendicularly thereto. A transition portion is integrally connects the main plate to each of the shield tabs. The transition portions each include a bend in which the transition portion is bent at substantially right angles, and integral fillets smoothly connecting the periphery of the main plate and side edges of the shield tabs for moderating the concentration of stress at the edges of the transition portions. The fillets of the transition portions may be in a plane of the main plate, or the fillets of the neighboring sides of two adjacent transition portions may define together a substantially continuous single curved edge. Alternatively, the bend of the transition portion may have a radius of curvature sufficiently large moderate the stress concentration at the bent surfaces of the transition portion.

BRIEF DESCRIPTION OF THE DRAWINGS

The present invention will become more readily apparent from the following detailed description of the preferred embodiment of the present invention, in which.

DESCRIPTION OF THE PREFERRED EMBODIMENT

Figure 1:
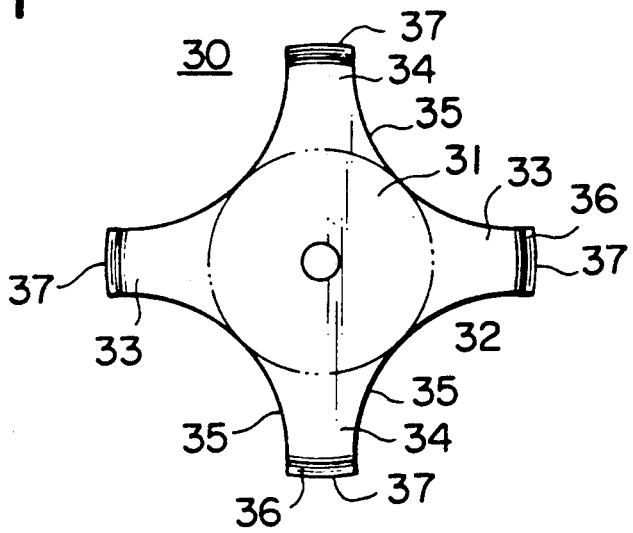
FIG. 1 is a plan view of the rotary magnetic shield of the present invention.
Figure 2:
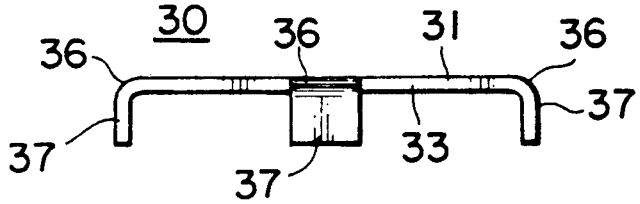
FIG. 2 is a side view of the rotary magnetic shield of the present invention illustrated in FIG. 1.
Figure 6:
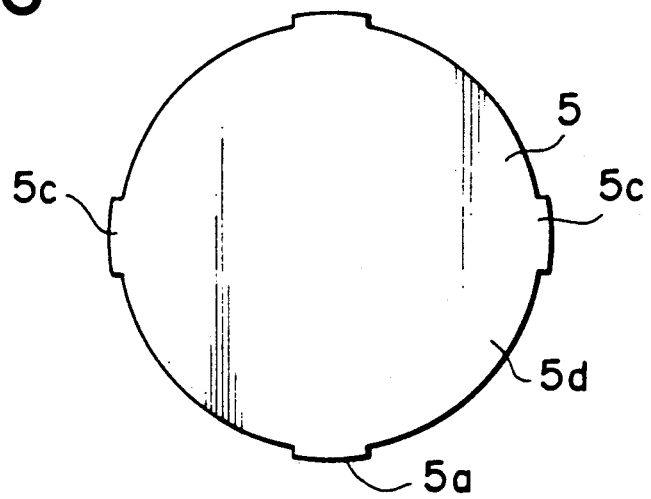
FIG. 6 is a plan view of the conventional rotary magnetic shield.
Figure 7:
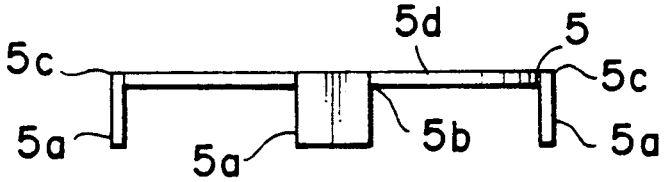
FIG. 7 is a side view of the conventional rotary magnetic shield illustrated in FIG. 6.
Figure 8:
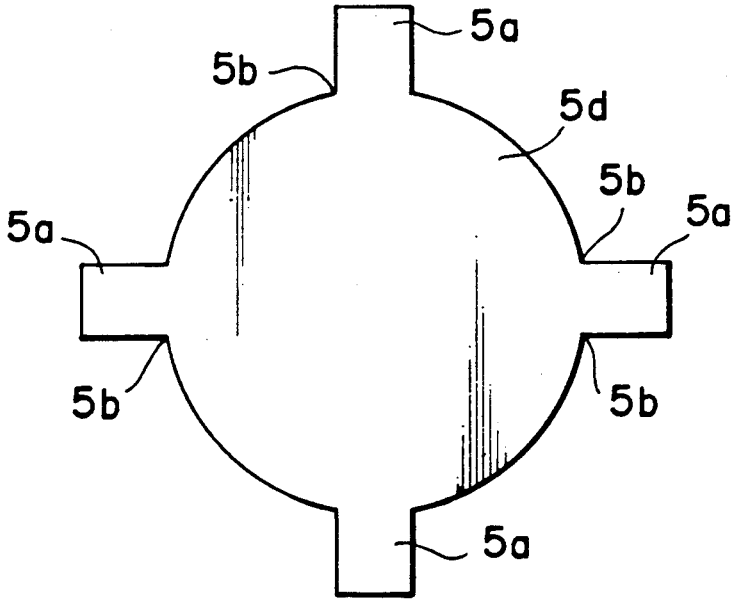
FIG. 8 is a plan view of a formed magnetic sheet material from which the shield tabs are bent to form the conventional magnetic shield illustrated in FIGS. 6 and 7.
Figure 4:
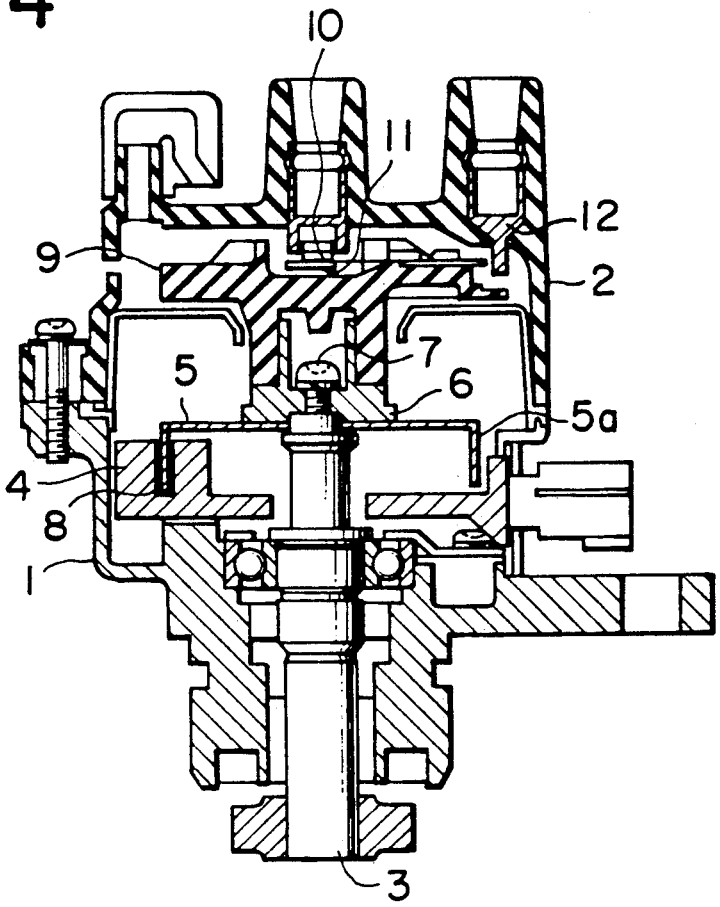
FIG. 4 is a sectional side view of a conventional distributor for an internal combustion engine.
Figure 5:
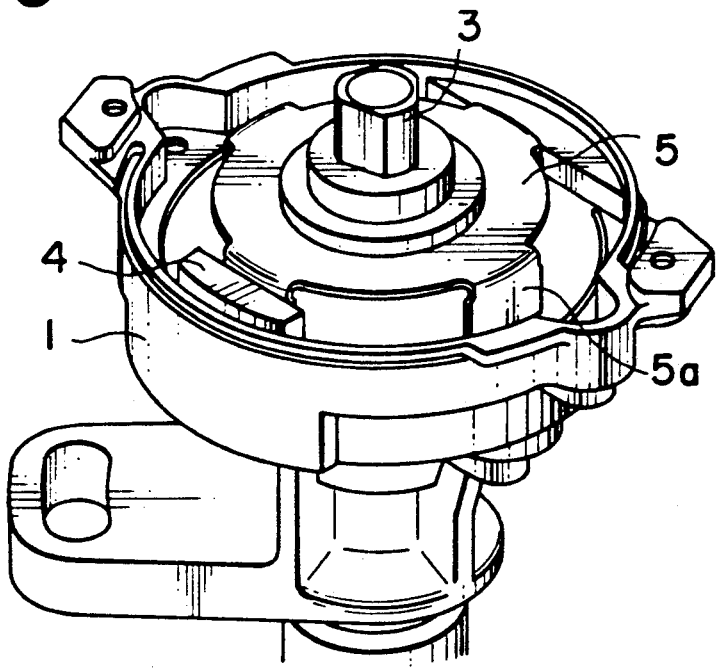
FIG. 5 is a perspective view of the conventional distributor for an internal combustion engine illustrated in FIG. 4.

FIGS. 1 and 2 illustrate a rotary magnetic shield 30 of the distributor for an internal combustion engine of the present invention which has a basic structure similar to that illustrated in FIGS. 4 and 5. The only difference is that the configuration of the rotary magnetic shield 30 is different from the rotary magnetic shield 5 illustrated in FIGS. 6 to 8, so that the description of other structure of the distributor will not be repeated.

In FIGS. 1 and 2, the rotary magnetic shield 30 comprises a substantially circular, disc-shaped main plate 31 attached at the center thereof through a central hole 32 to the rotary shaft 3 (FIGS. 4 and 5) for rotation therewith.

The main plate 31 has integrally formed on its periphery depicted by a circular phantom line four transition portions 33 radially extending from the main plate 31. Each of the transition portions 33 includes a flat, substantially trapezoidal portion 34 extending in a plane of the disc-shaped main plate 31. The trapezoidal portion 34 has curved sides or fillets 35 on both sides. The transition portion 33 also includes a round bend 36 extending integrally from an outer end of the trapezoidal portion 34 and bent at substantially right angles at a relatively large radius of curvature see FIG. 2) so that a stress concentration at this bent surface is substantially moderated.

Magnetic shield tabs 37 are integrally formed on the outer end of each of the round bends 36 of the transition portions 33 so that the shield tabs 37 extend substantially perpendicularly to the main plate 31.

The integral fillets 35 extending between the peripheral edge (see the phantom line circle) of the main disc plate 31 and the side edges of the magnetic shield tabs 37 serve to moderate concentration of stress at the side edges of the transition portions 33. In the illustrated embodiment, the fillets 35 of the neighboring sides of two adjacent transition portions 33 are configured to define together a substantially continuous, single curved edge having a very large, constant, radius of curvature. In other words, the area of the disc-shaped rotor plate 31 is very small as compared with that of the conventional design illustrated in FIG. 6, resulting in an advantage that the rotary magnetic shield can be made light weight.

Figure 3:
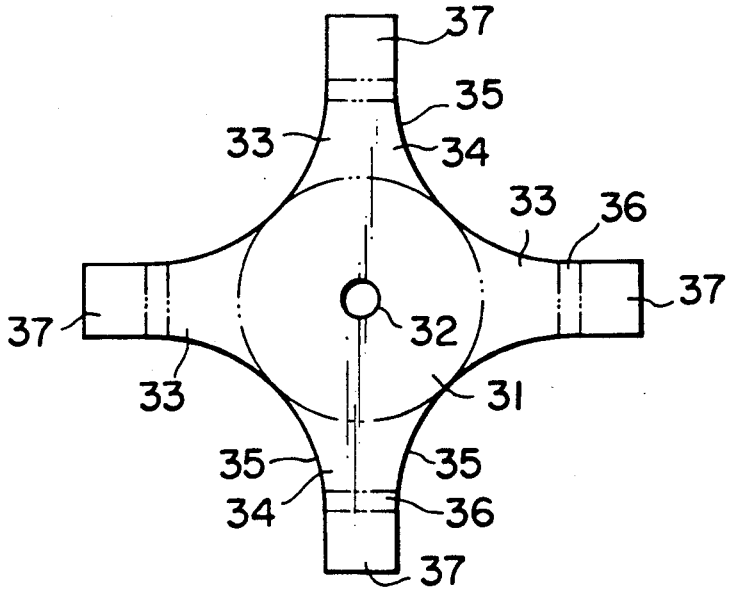
FIG. 3 is a plan view of a formed magnetic sheet material from which the shield tabs are bent to form the rotary magnetic shield of the present invention.

FIG. 3 illustrates a magnetic sheet material configured so that the rotary magnetic shield 30 illustrated in FIGS. 1 and 2 can be manufactured by bending the portion of the material corresponding to the bends 36 indicated by the phantom lines.

As has been described, the rotary magnetic shield of the present invention comprises a disc-shaped main plate attached at the center thereof to the rotary shaft for rotation therewith, a plurality of shield tabs disposed at the periphery of the main plate and extending substantially perpendicularly thereto and a transition portion integrally connected between the rotor main plate and each of the shield tabs. The transition portions each include, in addition to a round bend in which the transition portion is bent at substantially right angles, integral fillets smoothly connecting the periphery of the main plate and side edges of the shield tabs for moderating the concentration of stress at the edges of the transition portions. The bend of the transition portion may also have a radius of curvature sufficiently large for moderating the stress concentration at the bend surfaces of the transition portion.

Accordingly, even when the shield tabs 37 are subjected to engine vibration and centrifugal forces due to a high speed rotation of the rotary magnetic shield 30 during the operation of the internal combustion engine, the stresses on the edges between the circular rotor plate 31 and the side edges of the shield tabs 37 are significantly moderated and cracks cannot easily generate at the side edges. Therefore, the operating life of the distributor is greatly improved.

What is claimed is:

1. A distributor for an internal combustion engine, comprising:

a rotary shaft (3) adapted to be connected to an engine crank shaft for rotation therewith;

a power distributing electrode unit including a rotor electrode (11) attached to said rotary shaft and stationary electrodes (12) disposed around said rotor electrode for distributing electrical power; and a rotational signal generator (4) for generating an electrical signal indicative of a rotational speed of said rotary shaft, said rotational signal generator including a magnetic flux generator, a magnetic flux detector and a rotary magnetic shield (30) attached to said rotary shaft for intermittently presenting a magnetic flux shield between said magnetic flux generator and said magnetic flux detector, said rotary magnetic shield comprising:

a main plate (31) attached at a center thereof to said rotary shaft for rotation therewith;

a plurality of equally spaced shield tabs (37) disposed at a periphery of said main plate and extending substantially perpendicularly thereto; and a plurality of transition portions (33) individually and integrally connecting said main plate to said shield tabs, each transition portion including a bend (36) proximate an associated shield tab at which said transition portion is bent at a substantially right angle, and a pair of integral fillets (35) defining curved side edges smoothly connecting the periphery of said main plate to sides of said bend to minimize the concentration of stress at the edges of said transition portions, wherein said fillets of said transition portions lie in a plane of said main plate, and wherein said fillets of neighboring sides of two adjacent transition portions define together a substantially continuous, single curved edge.

2. A distributor for an internal combustion engine as claimed in claim 1, wherein said bend of said transition portion has a radius of curvature sufficiently large to moderate stress concentration thereat.

3. A distributor for an internal combustion engine as claimed in claim 1, wherein each said single curved edge has a substantially constant radius of curvature.

* * * * *